US007004078B2

(12) United States Patent
Nishimura et al.

(10) Patent No.: US 7,004,078 B2
(45) Date of Patent: Feb. 28, 2006

(54) TRUCK FOR RAILROAD CAR

(75) Inventors: Takehiro Nishimura, Hyogo (JP); Keisuke Takahashi, Hyogo (JP); Yasufumi Okumura, Hyogo (JP); Junichi Sakamoto, Hyogo (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/694,581

(22) Filed: Oct. 27, 2003

(65) Prior Publication Data

US 2004/0123767 A1 Jul. 1, 2004

(30) Foreign Application Priority Data

Oct. 30, 2002 (JP) ..... 2002-315428

(51) Int. Cl.
*B61D 1/00* (2006.01)

(52) U.S. Cl. ..... 105/157.1

(58) Field of Classification Search ..... 105/157.1, 105/158.1, 158.2, 182.1, 185, 186, 193, 197.05, 105/226

See application file for complete search history.

(56) References Cited

U.S. PATENT DOCUMENTS 5,924,654 A * 7/1999 Anderson ..... 246/169 R
6,401,627 B1 * 6/2002 Fehrenbach et al. ..... 105/182.1

FOREIGN PATENT DOCUMENTS

JP 11-029040 2/1999

* cited by examiner

*Primary Examiner*—S. Joseph Morano
*Assistant Examiner*—Robert J. McCarry, Jr.
(74) *Attorney, Agent, or Firm*—Marshall, Gerstein & Borun LLP

(57) ABSTRACT

In a truck for railroad car capable of absorbing and reducing deformation due to torsional force acting on an end beam, end portions of right and left side frames 2*a* and 2*b* of a truck frame 2 are connected by an end beam 3. An antenna support member 4 is supported by the end beam 3. The end beam 3 includes antenna brackets 3*a* and 3*b*, as right and left support brackets, connected and fixed to outer end portions of the right and left side frames 2*a* and 2*b* by fastening tools 5, and a center bar 3*c* connected to inner end portions of the right and left antenna brackets 3*a* and 3*b* through rubber bushes 6 and 7 and having an antenna support member 4. The rubber bushes 6 and 7 are positioned at both sides of the antenna support member 4 of the end beam 3, include elastic rubber members 6*a* and 7*a*, and absorb the torsional force acting on the end beam 3 by elastic deformation of the elastic rubber members 6*a* and 7*a*.

4 Claims, 5 Drawing Sheets

TRUCK FOR RAILROAD CAR

BACKGROUND OF THE INVENTION

1. Field of the Invention

The present invention relates to a truck for railroad car, and particularly to a truck for railroad car including an end beam for supporting an instrument.

2. Description of the Related Art

As a truck for railroad car, there is known one having an H-shaped, when viewed in plan, truck frame in which a transom is connected to intermediate portions, in a longitudinal direction of a railroad car, of side frames extending substantially in parallel at both right and left sides of a truck (for example, see JP-A-11-29040). In such a truck, from the necessity of supporting an instrument such as an antenna device, there is a case where an end beam (a beam extending in a lateral direction of the truck) is attached so as to connect the rear end portions (or front end portions) of the side frames, and the instrument is supported at the end beam.

Both end portions of the end beam as stated above are attached to the end portions (the rear end portions or front end portions) of the side frames of the truck. This attachment is typically performed by welding, or by bolt coupling. That is, the attachment of the end beam to the side frames is generally rigid connection.

When the end beam is rigidly connected to the side frames of the truck as stated above, there are disadvantages as described below.

Although a railroad on which a railroad car (truck) travels is constituted by two right and left rails, they are not always provided horizontally and in parallel according to the state of the ground on which the rails are installed. When they are not horizontal or in parallel as stated above, the relative positions of the right and left side frames of the truck are shifted in the vertical direction, and the truck frame is deformed such that the truck frame is deformed under torsion relative to the transom. In this deformation, although the amount of deformation of the truck frame near the transom is small, the amount of deformation of the truck frame near the end beam distant from the transom becomes large. Thus, in view of the fact that the amount of deformation of the truck frame near the end beam distant from the transom becomes large, it is necessary to increase the rigidity so that the stress generated at the end beam does not become larger than required, which causes an increase in weight of the truck frame.

SUMMARY OF THE INVENTION

The present invention has been made to solve the above problem, and has an object to provide a truck for railroad car which can absorb and reduce deformation by torsional force acting on an end beam.

According to the present invention, there is provided a truck for railroad car comprising an H-shaped, when viewed in plan, truck frame including side frames extending substantially in parallel at both right and left sides of the truck for railroad car, and a transom connected to intermediate portions of the side frames, the intermediate portions being substantially at a center in a longitudinal direction of a railroad car, an end beam extending in a lateral direction of the railroad car and connected to end portions of the right and left side frames of the truck frame, an instrument being supported by the end beam, and deformation absorbing means provided at both sides of a portion of the end beam where the instrument is supported, for absorbing torsional force acting on the end beam. Here, the deformation absorbing means may be provided at any position as long as the torsional force acting on the end beam can be absorbed and reduced, and may be located at any portion on both right and left sides of the instrument between the side frames. For example, both end portions of the end beam may be directly softly connected to the end portions (front end portions or rear end portions) of the side frames with the deformation absorbing means placed in the end beam. Besides, the deformation absorbing means may be any means as long as the torsional force acting on the end beam can be absorbed, and for example, the elasticity of elastic rubber, or the elasticity of a plate spring or a coil spring can be used.

In accordance with this structure, when the truck frame is deformed under torsion, the end beam starts to be significantly deformed under torsion, however, the torsional force is absorbed and reduced by the deformation absorbing means provided at the end beam. Since the deformation absorbing means are provided at both sides of the portion of the end beam where the instrument is supported, the torsional force does not act on the attachment portion of the instrument.

Preferably, the end beam includes right and left support brackets whose outer edges are connected to the right and left side frames, and a center bar connected to inner end portions of the right and left support brackets through the deformation absorbing means and having an instrument attachment portion, each of the deformation absorbing means is constructed by a rubber bush including an outer cylindrical member, a center shaft member, and an elastic rubber member provided therebetween, the outer cylindrical members are respectively connected to end portions of the center bar, and the center shaft members are respectively connected to the right and left brackets.

In accordance with this structure, since the rubber bushes are used to softly connect the end beam to the side frames, even if the outer cylindrical member connected to the end portion of the center bar and the center shaft member connected to the support bracket (side frame) are relatively shifted, the displacement is naturally absorbed by the deformation of the elastic rubber member. Thus, by the simple structure in which the rubber bush is used as the deformation absorbing means, the torsional force acting on the end beam can be absorbed and reduced.

The end beam comprises the right and left support brackets whose outer ends are connected to the right and left side frames, and the center bar provided between the right and left support brackets, and the deformation absorbing means are provided between the left support brackets and the center bar and between the right support brackets and the center bar. Thus, the rubber bushes can be assembled before the end beam is attached to the side frames, or after the right and left support brackets are attached to the side frames, the center bar can also be attached through the rubber bushes.

Besides, the instrument is an antenna device supported by means of an antenna support member, and a wiring attachment portion for fixing a wire to the antenna device may be provided at the center bar.

In accordance with this structure, in the case where the antenna device as the instrument is provided on the center bar (end beam) by means of the antenna support member, the wire to the antenna device can be stably attached and supported by the wiring attachment portion. Thus, since the wire connected to the antenna device is once supported by the center bar, compulsory force does not act on the wire even if the end beam is deformed.

Besides, the wiring from the side frame to the antenna device through the wiring attachment portion of the center bar (end beam) is formed, and the wire is supported by the wiring attachment portion, so that the wire does not have influence on other areas and other components in the truck.

The above and further objects and features of the invention will be more fully apparent from the following detailed description with accompanying drawings.

DETAILED DESCRIPTION OF THE PREFERRED EMBODIMENTS

Hereinafter, an embodiment of the invention will be described with reference to the drawings.

Figure 1:
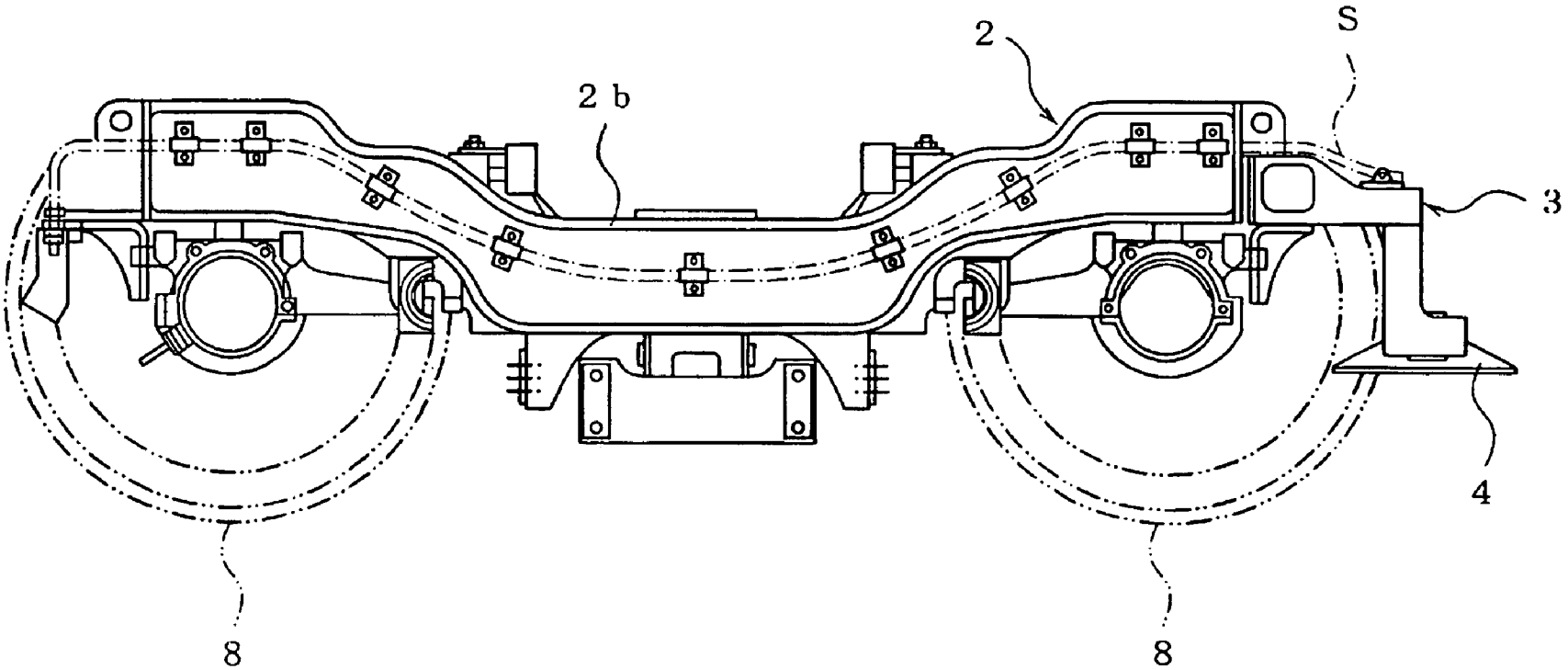
FIG. 1 is a front view showing a truck for railroad car of an embodiment of the invention.
Figure 2:
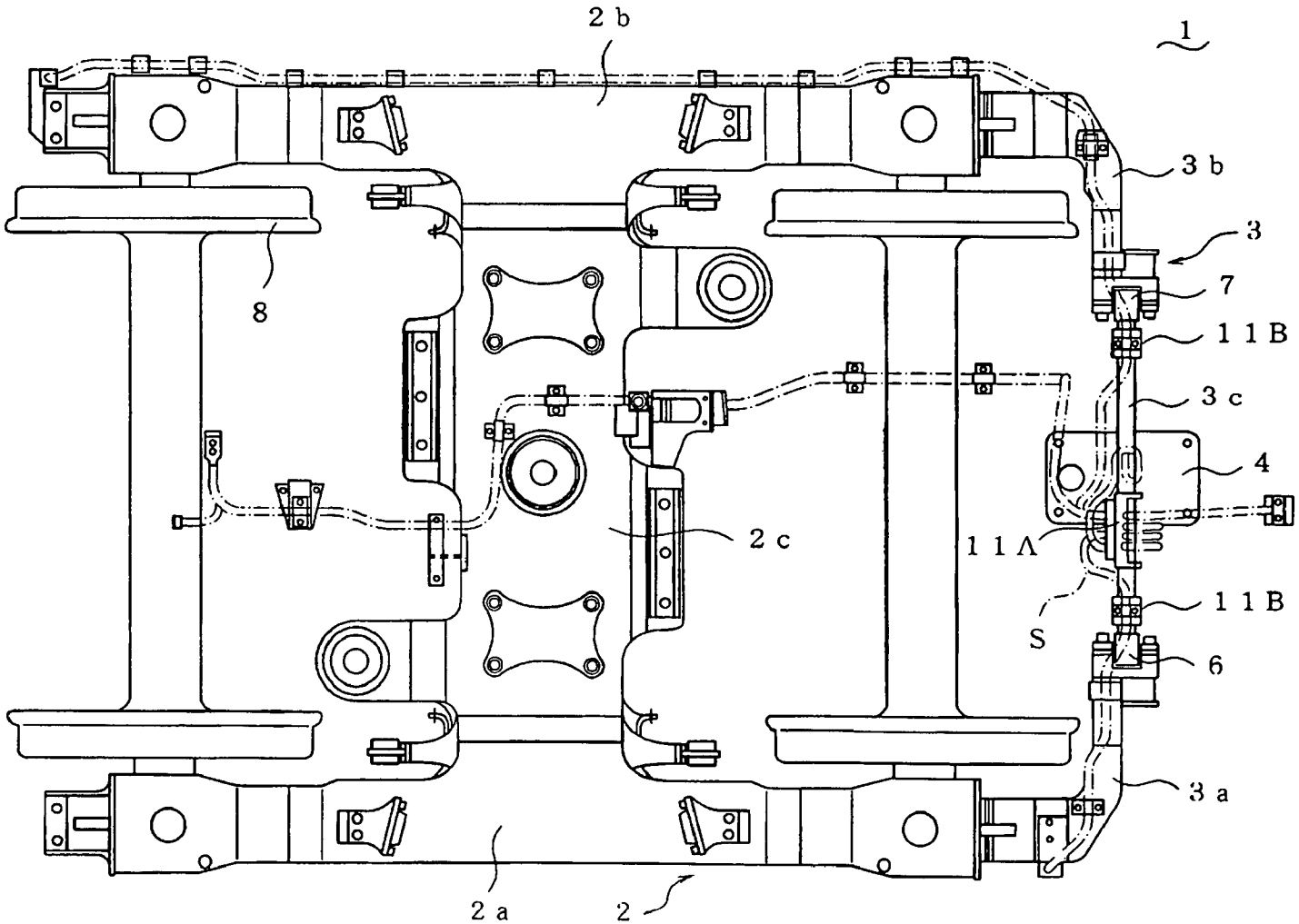
FIG. 2 is a plan view showing a truck for railroad car of an embodiment of the invention.
Figure 3:
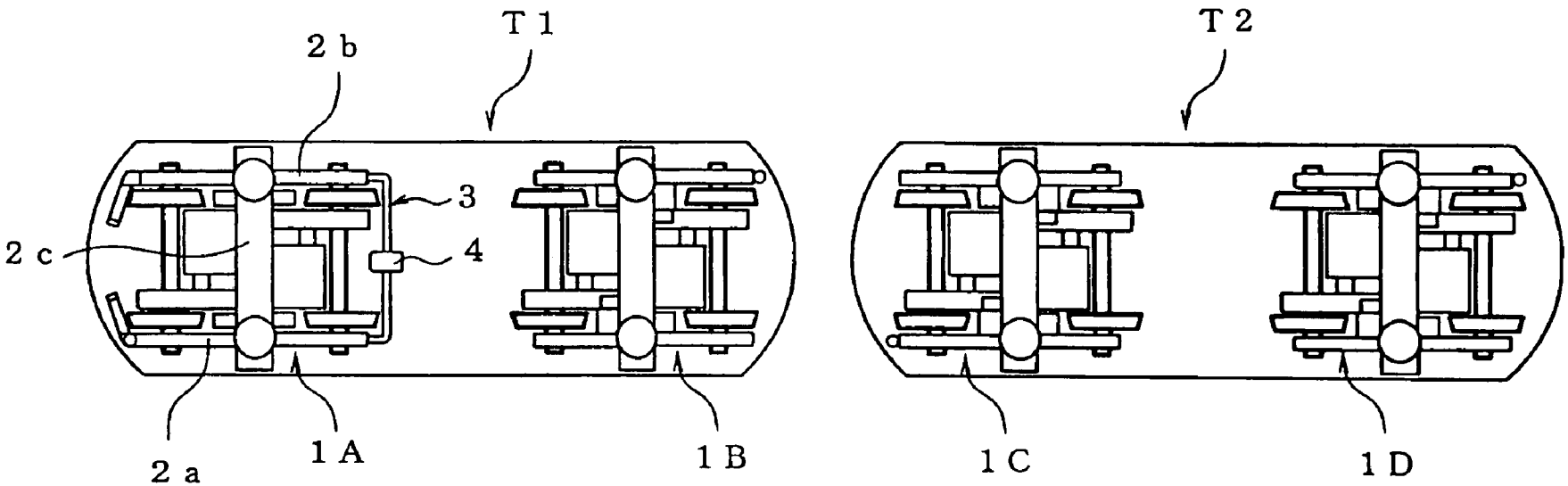
FIG. 3 is an explanatory view of a train composition.

FIG. 1 is a front view showing a truck for railroad car of the embodiment of the invention, FIG. 2 is a plan view of the same, and FIG. 3 is an explanatory view of a train composition.

A truck 1 for railroad car of the invention includes an H-shaped, when viewed in plan, truck frame 2. This truck frame 2 includes side frames 2*a* and 2*b* extending substantially in parallel at both right and left sides thereof, and a transom 2*c* connected to intermediate portions of the side frames 2*a* and 2*b*. The intermediate portions are located substantially at a center in the longitudinal direction of the railroad car. The rear ends of the right and left side frames 2*a* and 2*b* of the truck frame 2 are connected through an end beam 3 extending in the lateral direction of the railroad car, and an antenna device A (see FIG. 4) as an instrument is attached to the end beam 3 by an antenna support member 4 so as to be supported by the antenna support member 4.

The end beam 3 includes antenna brackets 3*a* and 3*b* as right and left support brackets and a center bar 3*c*. The outer end portions of the antenna brackets 3*a* and 3*b* are connected and fixed to the rear end portions of the right and left side frames 2*a* and 2*b* by fastening tools 5 (bolts or the like). The inner end portions of the right and left antenna brackets 3*a* and 3*b* are elastically connected to the right and left end portions of the center bar 3*c* through rubber bushes 6 and 7 (deformation absorbing means). The antenna support member 4 is provided substantially at the center position of this center bar 3*c*.

Although the rubber bushes 6 and 7 are provided at the end beam 3, they are positioned at both sides of the antenna support member 4. The rubber bushes 6 and 7 include elastic rubber members 6*a* and 7*a* (elastic bodies), and in the case where the truck frame 2 causes deformation under torsion, the elastic deformation of the elastic rubber members 6*a* and 7*a* absorb the torsional force acting on the end beam 3.

Since both end portions of the end beam 3 are rigidly connected to the side frames 2*a* and 2*b*, the support condition (rigidity) for supporting the heavy antenna device A (antenna support member 4) is secured, and the end beam can stably support it.

Since the end beam 3 as stated above is provided to support the antenna device A (antenna support member 4) located under the end beam 3, the end beam 3 is not required to be provided on plural trucks in the train composition, and is provided on merely a specified truck. That is, for example, as shown in FIG. 3, in the case where a train is made up of two cars of railroad cars T1 and T2 and includes four trucks 1A to 1D, the end beam 3 is provided at the rear side of the one truck 1A. That is, the end beam 3 is not provided in the remaining trucks 1B to 1D.

Figure 4:
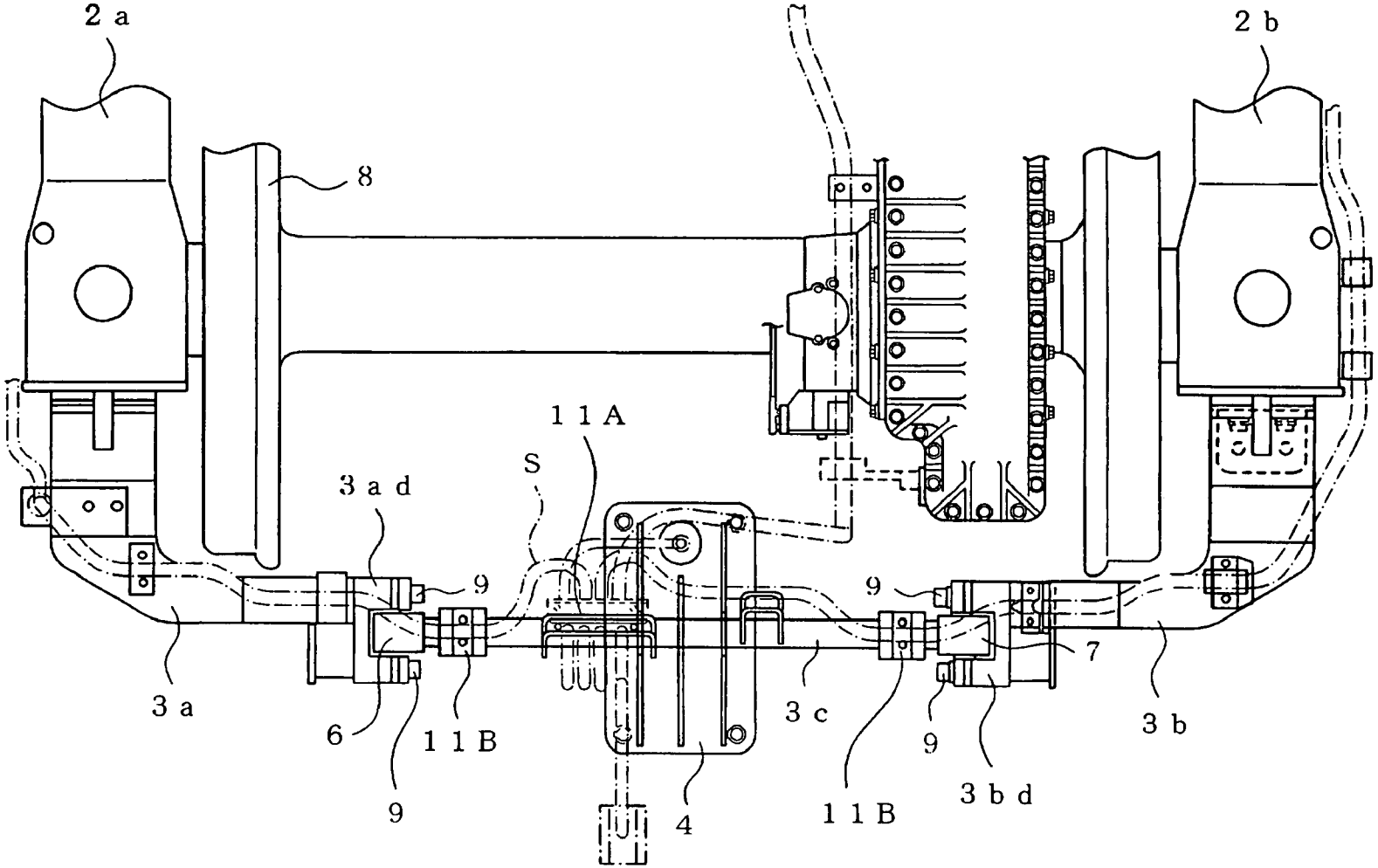
FIG. 4 is a plan view showing a vicinity of an end beam.
Figure 5:
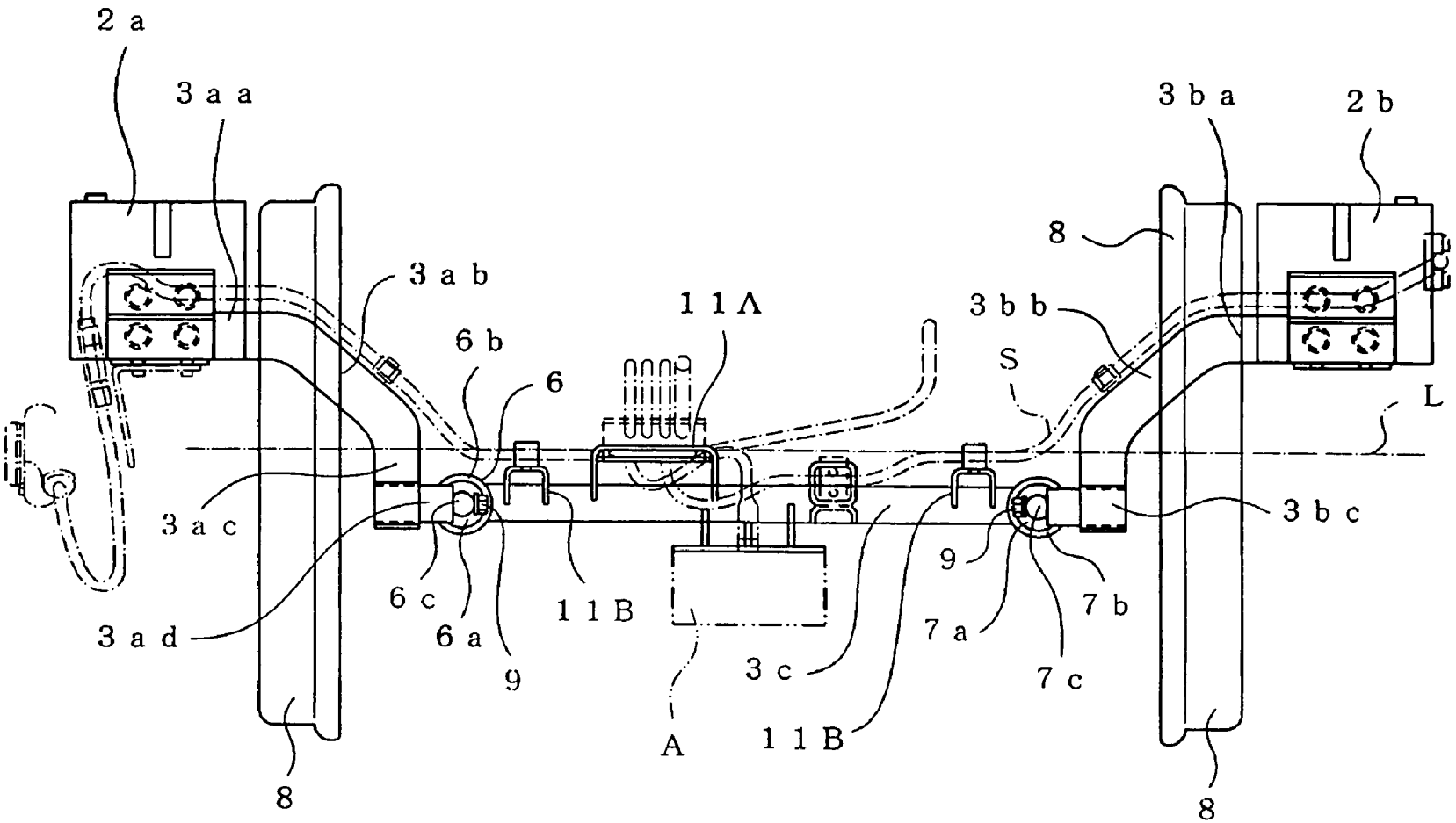
FIG. 5 is a rear view showing a vicinity of an end beam.

The rubber bushes 6 and 7 have the shaft center in the longitudinal direction of the truck as shown in FIG. 4 and FIG. 5, include outer cylindrical members 6*b* and 7*b*, center shaft members 6*c* and 7*c*, and the elastic rubber members 6*a* and 7*a* provided respectively between outer cylindrical member 6*b* and center shaft members 6*c* and between outer cylindrical member 7*b* and center shaft members 7*c*. The outer cylindrical members 6*b* and 7*b* are respectively connected to both end portions of the center bar 3*c* by welding. The center axial members 6*c* and 7*c* are attached and fixed to the center side end portions of the right and left antenna brackets 3*a* and 3*b* by screw means 9. Incidentally, for the attachment of the rubber bushes 6 and 7 (center shaft members 6*c* and 7*c*), C-shaped, when viewed in plan, support bracket portions 3*ad* and 3*bd* are integrally provided at the center side end portions of the right and left antenna brackets 3*a* and 3*b* by welding.

The antenna brackets 3*a* and 3*b* include, as shown in FIG. 5, horizontal portions 3*aa* and 3*ba* extending toward the center side of the truck in the lateral direction from the vicinities of the side frames 2*a* and 2*b* in the horizontal direction, inclined portions 3*ab* and 3*bb* extending downward toward the center side of the truck in the lateral from the inner end portions of the horizontal portions 3*aa* and 3*ba*, and vertical portions 3*ac* and 3*bc* further extending vertically downward from the lower ends of the inclined portions 3*ab* and 3*bb*. In the vicinities of the lower ends of the vertical portions 3*ac* and 3*bc*, the antenna brackets are connected to the right and left end portions of the center bar 3*c* through the rubber bushes 6 and 7, and elastically support the center bar 3*c*. The position where the center bar 3*c* is supported is lower than a line L connecting the centers of wheels 8.

In this structure, for example, when the railroad car (truck 1) is deformed under torsion under the inappropriate condition of the railroad on which it travels, the right and left side frames 2*a* and 2*b* are relatively shifted relative to the transom 2*c*. More specifically, the center shaft members 6*c* and 7*c* of the right and left rubber bushes 6 and 7 connected to the antenna brackets 3*a* and 3*b* (the side frames 2*a* and 2*b*) are at different position in the vertical direction. On the other hand, since the outer cylindrical members 6*b* and 7*b* connected to the end portions of the center bar 3*c* keep substantially the same position in the vertical direction. As a result, the center shaft members 6*c* and 7*c* connected to the antenna brackets 3*a* and 3*b* (the side frames 2*a* and 2*b*) are relatively displaced with respect to the outer cylindrical members 6*b* and 7*b*. However the displacement of the center shaft members 6*c* and 7*c* is naturally absorbed by the deformation of the elastic rubber members 6*a* and 7*a*. Thus, by using the rubber bushes 6 and 7 of the simple structure as described before, the torsional force acting on the end beam 3 can be naturally absorbed and reduced by the deformation of the elastic rubber members 6*a* and 7*a*.

Wiring attachment portions 11A and 11B are provided at the upper side of the end beam 3 (the antenna brackets 3*a* and 3*b*, the center bar 3*c*). A wire 5 extending to the antenna support member 4 (antenna device A) is fixed to the wiring attachments 11A and 11B. With this structure, wiring to the antenna device A is carried out without difficulty by using the end beam 3 having high support condition (high rigidity).

In the above embodiment, although a brake has not been described, a disk brake is adopted as the brake, and in the case where the disk brake is provided at the side frame or the end beam, when the rubber bushes 6 and 7 are provided at the end beam, the amount of deformation of the end beam 3 becomes large, and it becomes too soft. When it becomes too soft as stated above, in the case of the disk brake, there is a possibility that the brake performance is influenced, and therefore, it is desirable that the truck be provided with a tread brake unit, as brake means, having a brake shoe coming in contact with the tread of a wheel. This is because, since the tread brake unit is normally provided at the transom having less deformation, high support condition is not required for the end beam contrary to the case where the disk brake is adopted.

This invention is carried out as described above, and has effects as described below.

In the invention, since the deformation absorbing means for absorbing the torsional force acting on the end beam are provided at both sides of the portion of the end beam where the instrument is supported, even if the truck frame is deformed and the end beam starts to be significantly deformed, the torsional force is naturally absorbed by the deformation absorbing means and can be reduced.

When the deformation absorbing means is constructed by the rubber bush including the outer cylindrical member, the center shaft member, and the elastic rubber member provided therebetween, the structure is not complicated.

As this invention may be embodied in several forms without deportioning from the spirit of essential characteristics thereof, the present embodiment is therefore illustrative and not restrictive, since the scope of the invention is defined by the appended claims rather than by the description preceding them, and all changes that fall within metes and bounds of the claims, or equivalent of such metes and bounds thereof are therefore intended to be embraced by the claims.

The invention claimed is:

1. A truck for a railroad car comprising:

an H-shaped, when viewed in plan, truck frame including side frames extending substantially in parallel at both right and left sides of the truck for railroad car, and a transom connected to intermediate portions of the side frames, the intermediate portions being located substantially at a center in a longitudinal direction of a railroad car;

an end beam extending in a lateral direction of the railroad car and connected to end portions of the right and left side frames of the truck frame, wherein the end beam includes right and left support brackets whose outer ends are connected to the right and left side frames, and a center bar connected to inner end portions of the right and left support brackets through a deformation absorbing means and having an instrument attachment portion the end beam being configured to support an instrument; and wherein the deformation absorbing means is included in the end beam and located at both sides of a portion of the end beam where the instrument is supported, for absorbing torsional force acting on the end beam.

2. A truck for a railroad car comprising:

an H-shaped, when viewed in plan, truck frame including side frames extending substantially in parallel at both right and left sides of the truck for railroad car, and a transom connected to intermediate portions of the side frames, the intermediate portions being located substantially at a center in a longitudinal direction of a railroad car;

an end beam extending in a lateral direction of the railroad car and connected to end portions of the right and left side frames of the truck frame, an instrument being supported by the end beam; and deformation absorbing means provided at both sides of a port of the end beam where the instrument is supported, for absorbing torsional force acing on the end beam, wherein the end beam includes right and left support brackets whose outer ends are connected to the right and left side frames, and a center bar connected to inner end portions of the right and left support brackets through the deformation absorbing means and having an instrument attachment portion, and the right and left support brackets through the deformation absorbing means and having an instrument attachment portion, and each of the deformation absorbing means is constructed of a rubber bush including an outer cylindrical member, a center shaft member, and an elastic rubber member provided between the outer cylindrical member and the center shaft member, the outer cylindrical members are respectively connected to end portions of the center bar, and the center shaft members are respectively connected to the right and left support brackets.

3. The truck for railroad car according to claim 1, wherein the instrument is an antenna device supported by an antenna support member, and a wiring attachment portion for fixing a wire to the antenna device is provided at the center bar.

4. The truck for railroad car according to claim 2, wherein the instrument is an antenna device supported by an antenna support member, and a wiring attachment portion for fixing a wire to the antenna device is provided at the center bar.

* * * * *

UNITED STATES PATENT AND TRADEMARK OFFICE

CERTIFICATE OF CORRECTION

PATENT NO. : 7,004,078 B2
APPLICATION NO. : 10/694581
DATED : February 28, 2006
INVENTOR(S) : Takehiro Nishimura et al.

It is certified that error appears in the above-identified patent and that said Letters Patent is hereby corrected as shown below:

In the Claims:

At Column 6, Line 24, "acing" should be -- acting --.

Signed and Sealed this

Sixth Day of March, 2007

JON W. DUDAS
*Director of the United States Patent and Trademark Office*